US006175817B1

(12) United States Patent
Mueller et al.

(10) Patent No.: US 6,175,817 B1
(45) Date of Patent: Jan. 16, 2001

(54) METHOD FOR VECTOR QUANTIZING SPEECH SIGNALS

(75) Inventors: Joerg-Martin Mueller, Schwaikheim; Bertram Waechter, Allmersbach/Tal, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/080,778

(22) Filed: May 18, 1998

Related U.S. Application Data

(63) Continuation-in-part of application No. 08/535,293, filed on Nov. 20, 1995, now abandoned.

(51) Int. Cl.[7] ..... G10L 19/14
(52) U.S. Cl. ..... 704/222
(58) Field of Search ..... 704/219, 222

(56) References Cited

U.S. PATENT DOCUMENTS

| | | | | |
|---|---|---|---|---|
| 4,903,301 | * | 2/1990 | Kondo et al. | 395/2.09 |
| 5,199,076 | * | 3/1993 | Taniguchi et al. | 395/2.28 |
| 5,208,862 | * | 5/1993 | Ozawa | 395/2.28 |
| 5,230,036 | * | 7/1993 | Akamine et al. | 395/2.09 |
| 5,261,027 | * | 11/1993 | Taniguchi et al. | 395/2.09 |
| 5,487,128 | * | 1/1996 | Ozawa | 395/2.31 |

FOREIGN PATENT DOCUMENTS

| | | | | |
|---|---|---|---|---|
| 0-545-386-A3 | * | 9/1993 | (JP) | G10L/9/14 |

OTHER PUBLICATIONS

"Improving performance of Code Excited LPC–Coders by Joint Optimization", Muller, Speech Communication, Jun. 15, 1989.*

"Improvements to the analysis by synthesis loop in CELP code", Radio Receivers and Associated Systems, Woodard et al., Sep. 1995.*

"Pitch Sharpening for Perceptually improved CELP, and the spa", ICASSP '91, Taniguchi et al, Jul. 1991.*

* cited by examiner

*Primary Examiner*—Krista Zele
*Assistant Examiner*—Michael N. Opsasnick
(74) *Attorney, Agent, or Firm*—Michael J. Striker

(57) ABSTRACT

Two codebooks each consisting of a filter memory are used for vector quantizing of a speech sample. Fixed excitation vectors and pitch parameters of a prediction filter are entered in the respective codebooks, which are actualized in time intervals. To improve the speech quality, respectively two vectors from the adaptive codebook which are best in respect to an error criterion are linked with all vectors of the fixed codebook. The value which best matches an original speech scanned value is selected from the linkages. The entries in the first codebook are advantageously thinned out by suppressing vector components taken from sum bits of two frame sections into which the speech sample is divided until the processing work is no more than the processing work with only one selected best vector from the second codebook.

6 Claims, 3 Drawing Sheets

METHOD FOR VECTOR QUANTIZING SPEECH SIGNALS

CROSS-REFERENCES

The present application is a continuation-in-part of U.S. patent application Ser. No. 08/535,293, of Nov. 20, 1995, now abandoned. The present invention is also related, in part, to allowed copending U.S. patent application Ser. No. 08/530,204, filed Sep. 25, 1995, of J.-M. Müller, et al, entitled "Method of Preparing Data, in Particular Encoded Voice Signal Parameters".

BACKGROUND OF THE INVENTION

The invention relates to a method for coding of signal scanning values, making use of vector quantization and, more particularly, to a method of coding speech signals by vector quantization.

A CELP speech coding method is known from "Speech Communication" 8 (1989), pp. 363 to 369, wherein the coder parameters are optimized together. In comparison with sequential optimization, it is possible to considerably reduce the length of the excitation codebook.

A digital speech coder is known from WO 91/01545, wherein excitation vectors entered in a codebook are accessed for selecting an excitation vector which best represents the original speech scanning value. Two excitation vectors from two respective codebooks are employed for describing a scanned speech value in the speech coder in accordance with WO 91/01545. First, a first excitation vector is selected there independently of pitch information. The second excitation vector is selected in a corresponding manner. During orthogonalization of the second excitation vector from the second codebook, the resulting vector as well as the first selected excitation vector from the first codebook are taken into consideration. This selection process is then repeated with an orthogonalized excitation signal from the second codebook in order to finally identify those excitation vectors which best match the original speech scanning value.

SUMMARY OF THE INVENTION

It is the object of the instant invention to increase dependability in the selection of the optimized scanning value without too greatly increasing the processing effort and expense.

According to the invention, the method for vector quantizing of speech signals includes:

a) entering fixed excitation vectors of an LPC filter for speech prediction in a first codebook;

b) entering excitation vectors of a pitch synthesis filter in a second codebook;

c) modifying the excitation vectors in the second codebook (CB2) according to each speech sample sub-frame;

d) establishing a predetermined error criterion for selection of excitation vectors from the second codebook;

e) selecting at least two excitation vectors from the second codebook to obtain in optimum prediction value according to the predetermined error criterion;

f) linking the at least two excitation vectors selected in step e) with a number of excitation vectors from the first codebook to form a set of linked vectors; and g) selecting a resulting linked vector having a minimal variation from the speech signal according to a predetermined variation parameter.

There are several preferred embodiments of the method according to the invention. The predetermined variation parameter may be the same as the predetermined error criterion or different from it.

In a particularly preferred embodiment the method also includes thinning out the fixed excitation vectors in the first codebook. This thinning can occur by suppressing vector components taken from sum bits of two frame sections into which the speech signal is divided. The thinning out of the first codebook, in some embodiments, occurs to the extent that processing efforts are approximately as great as processing efforts would be with no thinning out and with only one selected excitation vector from the second codebook.

Advantageously the error or deviation of each excitation vector in the first codebook with respect to the speech signal can be determined considering the at least two pitch predictors selected from the second codebook.

The invention is based on the following realizations: If, in contrast to the known methods (as described in the prior art references, "Speech Communication" 8 (1989), pp. 363 to 369 or WO 91/01545), more than one vector with a minimal error from the adaptive (second) codebook is employed for linking with all vectors of the first (fixed) codebook, the processing effort (calculation effort) will increase, but the dependability in the optimization of the scanning value with the least error is increased. This increase of dependability means an increase in the speech quality when processing speech scanned scanning samples. Since, when taking into consideration more than one vector from the adaptive codebook, the processing effort increases less greatly than linearly, it is possible with a moderate reduction of the fixed codebook, for example by codebook thinning (frame thinning) in accordance with the U.S. patent application Ser. No. 08/530,204, filed Sep. 25, 1995, entitled "Method for Preparing Data, in particular Encoded Speech Signal Parameters", by the inventors of the present invention to keep the processing effort approximately constant, wherein the original codebook length without thinning is made the comparison basis. It is possible to obtain considerably better speech quality by means of the steps of the invention along with approximately the same processing effort as in conventional methods.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENT

Figure 1:
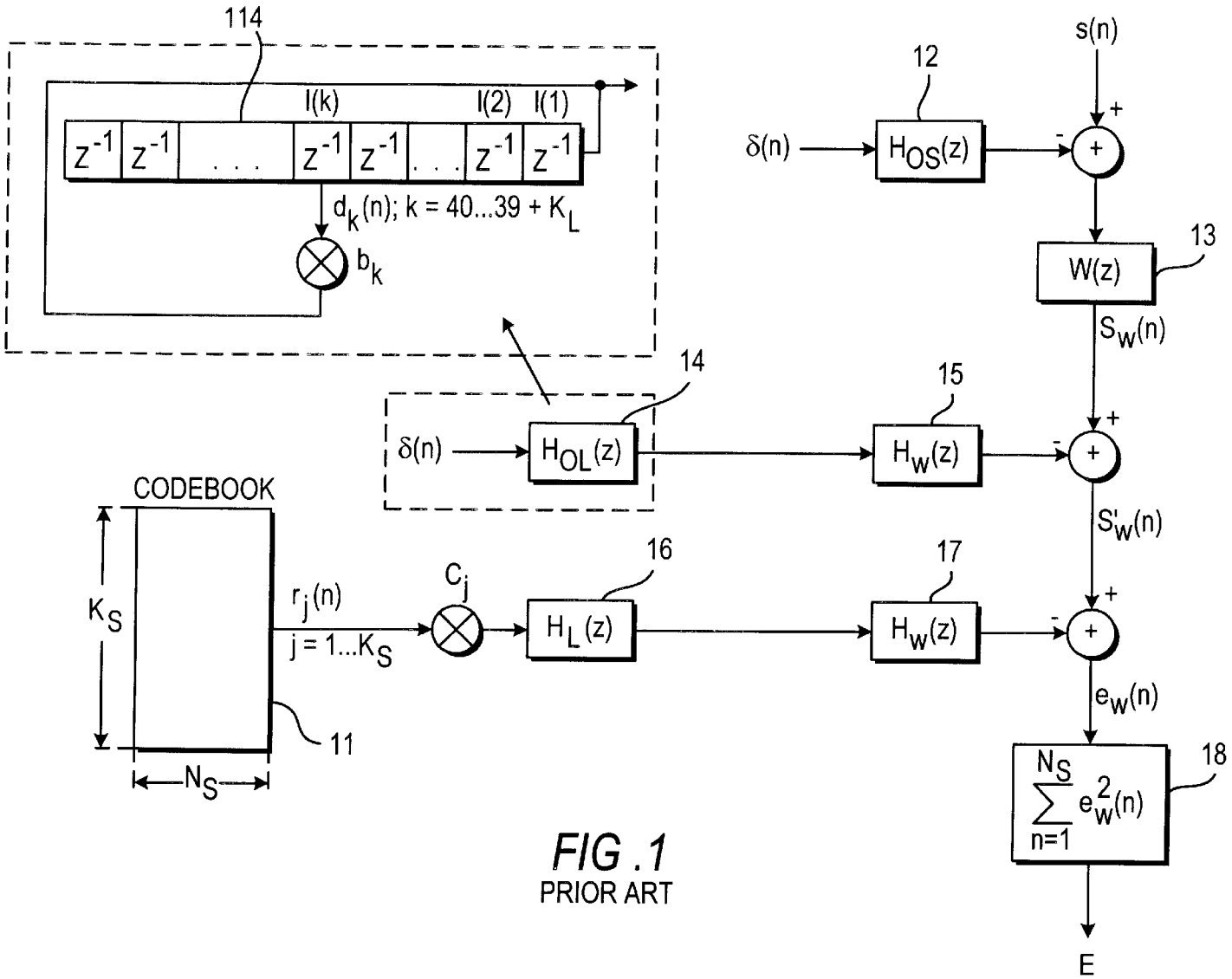
FIG. 1 PRIOR ART
FIG. 1 is a block diagram of a CELP coder of the prior art.

For a better understanding of the invention, reference is first made to the prior art method described in the prior art publication "Improving Performance of Code Excited LPC-Coders by Joint Optimization" in Speech Communication 8, (1989), pp. 363 to 369.

CELP (code-excited linear prediction) coders are members of the class of RELP (residual excited linear prediction) coders, wherein an actualization sequence of speech values is obtained by means of a filter representing the speech generation. The actualization sequence is obtained by means of a codebook, from which the best codebook vector is selected by means of an "analysis by synthesis" method. In this case, the best codebook vector means the vector with the greatest similarity to the original scanned speech value. This similarity is judged by means of a predetermined or preselected error criteria, for example the mean square error. First, the codebook 11 is filled with normally distributed random values. The structure of a CELP coder can be seen in FIG. 1. In a first step the contribution of the memory of the linear prediction filter, identified in FIG. 1 by the transmission function $H_{OS}(Z)$, is subtracted in block 12 of FIG. 1 from the scanned speech value, s(n), at the input side, and the resultant signal is weighted by a filter with the transmission function, W(Z), in block 13 to form a weighted speech signal $s_w(n)$. In a second step, the contribution of the weighted memory value of the pitch prediction filter (identified by the transmission functions $H_{OL}(Z)$ and $H_W(Z)$ in blocks 14 and 15) is subtracted from the weighted speech signal $s_w(n)$. Finally, the weighted error signal $e_w(n)$ is generated by forming the difference between the filtered codebook vector (filter functions $H_L(Z)$ and $H_W(Z)$ in blocks 16 and 17) and the previously detected signal $s'_w(n)$. The energy E of the error signal $e_w(n)$ in block 18 is a function of all code parameters, for example $$E=f(a_i, M, b_i, j, c_j),$$

wherein $a_i$ for i=1, 2, . . . , $P_S$, are the coefficients of the LP filter,

M, the pitch period, $b_i$ for i=1, 2, . . . , $P_L$ are the pitch predictor coefficients, j=1, 2, . . . $K_S$, the codebook entries and $c_j$, the corresponding scale factor.

The best possible speech quality is achieved if all these signal parameters are optimized together. The LP parameters $a_i$ are not considered in the subsequent optimization, since taking them into consideration would result in too difficult processing operations.

By minimizing the function $$E=f(M, b_i, j, c_j)$$

a sub-optimal approximation is achieved.

The linear prediction synthesis filter $$H_S(Z)=\left\{1-\sum_{i=1}^{P_S} a_i Z^{-i}\right\}^{-1}$$

describes the format structure of the speech spectrum. The weighting filter $$W(Z)=H_S(Z/\gamma)H_S(Z)^{-1}$$

with $0 \leqq \gamma \leqq 1$ provides a spectral noise limitation because of the incomplete excitation. $H_W(Z)$ provides the linkage of the LP filter and the weighting filter:

$$H_W(Z)=H_S(Z)\cdot W(Z).$$

The pitch prediction filter, which has only one tap at $P_L=1$, is described by the transmission function $$H_L(Z)=(1-bZ^{-M})^{-1}.$$

The memory cells of the filters $H_W(Z)$, $H_L(Z)$ and W(Z) in FIG. 1 are zero. The parameters of the pitch predictor are respectively actualized after Ns scanning values (sub-frame content) and those of the LP filter all scanning values. With the assumption $N \geqq Ns$ it is possible to remove the pitch prediction filter from the excitation branch in FIG. 1, since it does not affect the input of the filter $H_W(Z)$ for $$n \leqq Ns,$$

To explain the effect of the pitch predictor memory in more detail, its memory cells 114 and their linkage are shown in detail in FIG. 1. The values in the memory cells are identified by l(k). Each pitch period parameter M=k generates a different signal $d_k(n)$ at the output of the delay line formed from the memory cells. $K_L$ depends on the allowed range of the pitch period M. A good choice for M lies between 40 and 103. To cover this area, $K_L$ must equal 64.

Figure 2:
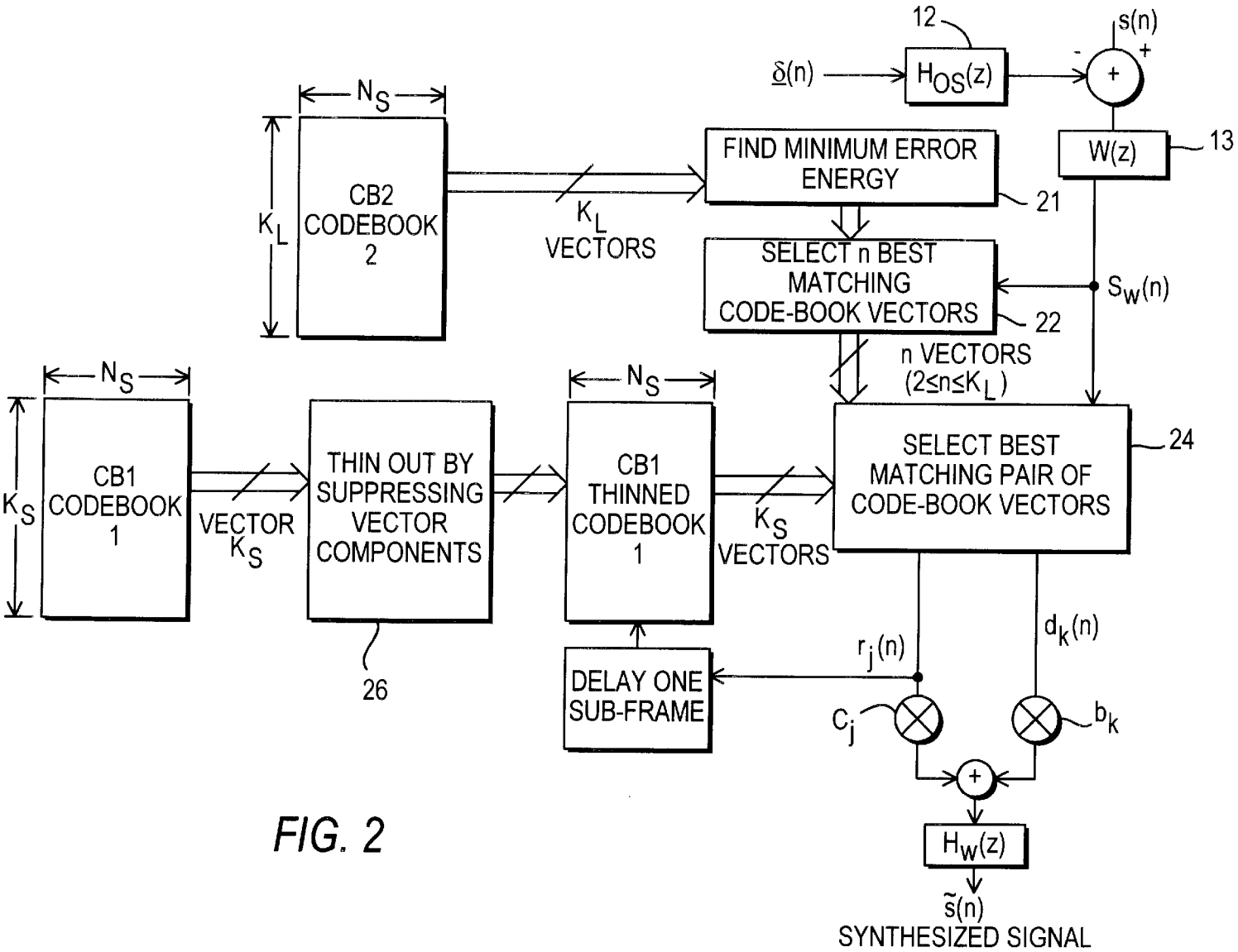
FIG. 2 is a block diagram of a CELP coder modified according to the invention.
Figure 3:
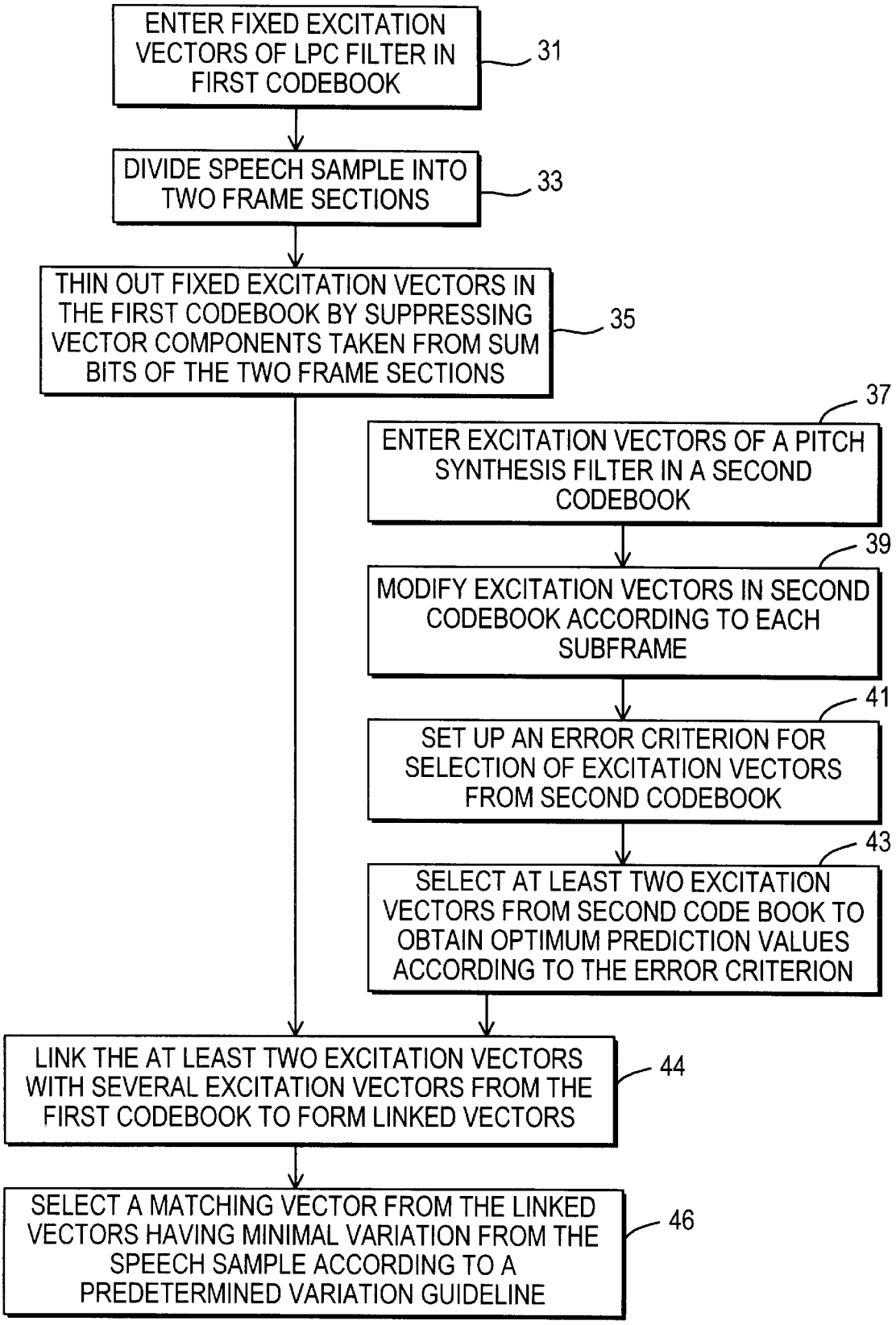
FIG. 3 is a flow chart of the method according to the invention.

These conditions lead directly to the block diagram of FIG. 2 and the embodiment of the method according to the invention shown in FIG. 3.

The $K_L$ different signals $d_k(n)$ can be considered to have been combined in a codebook. In this representation there is no difference between the structure of the branch with the excitation codebook CB1 and the branch with the codebook CB2, which arises from the filter memory of the pitch predictor. Only the characteristics of the two codebooks CB1 and CB2 are different: the excitation codebook CB1 is fixed—fixed vectors are entered e. g. in step 31 of FIG. 3—, while the codebook CB2 for the pitch parameter is time-dependent (adaptive), since the filter memory is modified after each sub-frame. To optimize these parameters it is necessary to search a large number ($K_L$ $K_S$) of different combinations to find the minimal error energy E in block 21 of FIG. 2, i.e. to set up an error criterion in step 41 of FIG. 3. All these combinations correspond to a codebook length $K_L$ $K_S$, while the sequential optimization corresponds to a two-stage vector quantization with two codebooks of the length $K_L$ and $K_S$.

In the block diagram according to FIG. 2, the error energy E is a function of the codebook entries j and k and the scaling factors $c_j$ and $b_K$:

$$E(j, k, b_k, c_j)=\sum_{n=1}^{N_S}\{S_W(n)-[(b_k, d_k(n)+c_jT_j(n))*h_\omega(n)]\}^2$$

wherein h(n) indicates the pulse answer of the weighted LP filter and * the folding symbol.

The following system of linear equations must be fulfilled for a minimum of the error energy regarding the scaling factors i.e. the excitation vectors must be modified to find the minimium as in step 39 of FIG. 3:

$$\begin{pmatrix} \langle p_k(n), p_k(n)\rangle & \langle p_k(n), q_j(n)\rangle \\ \langle p_k(n), q_j(n)\rangle & \langle q_j(n), q_j(n)\rangle \end{pmatrix}\begin{pmatrix} b_k \\ c_j \end{pmatrix}=\begin{pmatrix} \langle p_k(n), s_W(n)\rangle \\ \langle q_j(n), s_W(n)\rangle \end{pmatrix}$$

wherein $P_k(n)=d_k(n)*h_W(n)$, $q_j(n)=r_j(n)*h_W(n)$, and $$\langle a(n), b(n)\rangle=\sum_{n=1}^{N_S} a(n)\cdot b(n).$$

Using these relationships, the result for the minimal error energy is $$E_{min}=\langle S_W(n), S_w(n)\rangle-T(j,k,c_j,b_k).$$

Since the energy for a sub-frame is constant, the expression $$T(j,k,c_j,b_k)=b_k<P_k(n),S_w(n)>+c_j<q_j(n),S_W(n)>$$

must be maximized. This maximization is performed in two steps:

solution of the linear equation system, calculation of T (j, k, $c_j$, $b_n$).

These steps must be performed $K_L K_S$-times. The effort can be considerably reduced by means of further simplifications, for example setting approximately 90% of the vectors to zero, inverse filtering in accordance with DE 38 34 971 Cl, admission of only those vectors which have, for example, only three autocorrelation coefficients differing from the value zero.

In accordance with the invention and in contrast to methods up to now, n≧2, in the example n=2, best vectors are now selected from the second codebook CB2 (best vectors means that these vectors deliver the smallest deviations, i.e.—the best prediction values in respect to the error criteria, for example the mean square error) in step 43 shown in FIG. 3 and in block 22 of FIG. 2. These two best vectors are now linked in accordance with the previously mentioned system of linear equations with all present vectors from the first codebook CB1 containing the fixed vectors in step 44 shown in FIG. 3 and in block 24 of FIG. 2. The values which lie close to the original scanning value in the sense of minimal error energy (the same or further error criteria) are now selected from the amount of linkages or linked vectors and made available for transmission via a transmission channel with a low bit rate, for example as in step 46 shown in FIG. 3.

The processing effort increased by processing more than two best vectors from the second codebook leads to an improved speech quality. Without reducing this increased speech quality, the processing effort can be again reduced in that the entries in the first codebook are thinned out. Furthermore, the processing effort does not rise linearly with the number of selected vectors to be processed, since it is possible to refer back to many linkage results already calculated in the first step.

The thinning out of the codebook without a reduction in the speech quality is advantageously performed in step 35 shown in FIG. 3 and in block 26 of FIG. 2, that the sum bits of the vectors of two frame sections (sub-frames) (see step 33 of FIG. 3) are made the basis for the amount of thinning out, from which then preferably just so many bits are suppressed that the processing effort is approximately just as great as in processing of only one selected best vector from the second codebook CB2. The thinning out of the codebook is described in detail in the above-mentioned application, "Method for Processing Data, in particular Encoded Speech Signal Parameters" by the inventors of the instant application.

The thinning out of the second codebook takes place according to the method of application, Ser. No. 08/530,204. The total number of bits for the vectors is reduced so that the quantization stages are approximately equally distributed over individual intervals and so that the bit difference from the total number of unreduced bits with respect to the next-higher power of two is suppressed. This bit reduction process proceeds until the criteria in the above paragraph is met, namely just so many bits are suppressed that the processing effort is approximately just as great as in the processing of only one selected best vector from the second codebook.

While the invention has been illustrated and described as embodied in a method for vector quantizing speech signals, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A method for vector quantizing a speech sample, said method comprising the following steps:

a) entering fixed excitation vectors of an LPC filter for speech prediction in a first codebook (CB1), b) entering excitation vectors of a pitch synthesis filter in a second codebook (CB2);

c) modifying said excitation vectors in said second codebook (CB2) after each sub-frame;

d) establishing a predetermined error criterion for selection of excitation vectors from the second codebook (CB2);

e) selecting at least two of said excitation vectors from the second codebook (CB2) to obtain optimum prediction values according to said predetermined error criterion;

f) linking said at least two excitation vectors selected in step e) with a plurality of said excitation vectors from said first codebook (CB1) to form a set of linked vectors;

g) selecting a matching vector from said linked vectors having a minimal variation from said speech sample according to a predetermined variation guideline; and h) thinning out said fixed excitation vectors in said first codebook.

2. The method as defined in claim 1, further comprising determining an error of each of said linked vectors from said first codebook (CB1) in relation to the speech sample so as to take into consideration at least two pitch predictors selected from the second codebook (CB2).

3. The method as defined in claim 1, wherein said thinning out of the first codebook (CB1) occurs by suppressing vector components taken from sum bits of two frame sections into which said speech sample is divided.

4. The method as defined in claim 1, wherein said thinning out of the first codebook (CB1) occurs until processing efforts are no more than processing efforts would be with only one selected best one of said excitation vectors from the second codebook (CB2).

5. The method as defined in claim 1, wherein said predetermined variation guideline consists of said predetermined error criterion.

6. A method for vector quantizing a speech sample, said method comprising the following steps:

a) entering fixed excitation vectors of an LPC filter for speech prediction in a first codebook (CB1) comprising a first filter memory, b) entering excitation vectors of a pitch synthesis filter in a second codebook (CB2) comprising a second filter memory;

c) modifying said excitation vectors in said second codebook (CB2) after each sub-frame;

d) establishing a predetermined error criterion for selection of excitation vectors from the second codebook (CB2);

e) selecting at least two of said excitation vectors from the second codebook (CB2) to obtain optimum prediction values according to said predetermined error criterion;

f) linking said at least two excitation vectors selected in step e) with a plurality of said excitation vectors from said first codebook (CB1) to form a set of linked vectors;

g) selecting a matching vector from said linked vectors having a minimal variation from said speech sample according to a predetermined variation guideline; and h) thinning out said fixed excitation vectors in said first codebook, wherein said thinning out occurs by suppressing vector components taken from sum bits of two frame sections into which said speech sample is divided.

* * * * *